US006941944B2

(12) United States Patent
Hadfield

(10) Patent No.: US 6,941,944 B2
(45) Date of Patent: Sep. 13, 2005

(54) FIREPLACE AND FIREBACK THEREFOR

(76) Inventor: Douglas Hadfield, 8 Church Street, Helmdon, Brackley, Northamptonshire, NN13 5QJ (GB)

( * ) Notice: Subject to any disclaimer, the term of this patent is extended or adjusted under 35 U.S.C. 154(b) by 0 days.

(21) Appl. No.: 10/680,834

(22) Filed: Oct. 7, 2003

(65) Prior Publication Data

US 2004/0065318 A1 Apr. 8, 2004

(51) Int. Cl.[7] ..... F24B 1/18
(52) U.S. Cl. ..... 126/500; 126/312
(58) Field of Search ..... 126/500, 312, 126/512

(56) References Cited

U.S. PATENT DOCUMENTS 2,825,326 A * 3/1958 Flynn, Jr. ..... 126/553
3,301,249 A * 1/1967 Hendricks ..... 126/500
4,013,059 A * 3/1977 Andrews ..... 126/500
6,029,654 A * 2/2000 Wade ..... 126/512
2003/0019490 A1 * 1/2003 Buffington ..... 126/500

FOREIGN PATENT DOCUMENTS

CH 627832 A5 * 1/1982
CH 665012 A5 * 4/1988

* cited by examiner

*Primary Examiner*—Sara Clarke
(74) *Attorney, Agent, or Firm*—Paul E Milliken; Ray L Weber

(57) ABSTRACT

A fireback for use in domestic open fireplaces and which in use surrounds the fire bed and which extends upwardly to a throat (31) which in use connects with a chimney. The fireback (25) has walls with inner surfaces (26) that slope steadily inwardly from near its base (29) to the throat 31 decreasing the cross sectional area of the fireback, the larger area being at the level of the fire bed and smaller area being adjacent the throat 31.

13 Claims, 3 Drawing Sheets

FIREPLACE AND FIREBACK THEREFOR

FIELD

This invention relates to open fireplaces and firebacks of a type for use with open fireplaces.

BACKGROUND OF THE INVENTION

The modern fire place was largely devised by Count Rumford at the end of the 18th century. Count Rumford realised that the amount of smoke emitted into a room could be reduced by a reduction in the depth of the throat of the fireplace (from front to back). He also realised that the amount of heat radiated into a room could be increased by angling the side covings at about 45 degrees of arc to the back surface of the fireplace.

Rumford also discovered that if the upper part of the fireplace back wall is inclined forwards instead or being vertical, the heat given out is markedly increased. Modern firebacks as specified in BS 1251:1987 utilise much of the Rumford design having angled side covings with the upper back wall being inclined forwards at about 35 degrees of arc from the vertical starting at a height of about 340 mm (about 13.5 inches) from the base of the fireplace.

OBJECT OF THE PRESENT INVENTION

The present invention seeks to provide an improved fireplace which will eliminate smoke and increase the amount of heat radiated into a room.

STATEMENT OF INVENTION

According to the present invention there is provided a fireback for use in a domestic open fireplace and which in use surrounds the firebed and extends upwardly to a throat which in use is adjacent a chimney, the inner surface of the walls of the fireback sloping steadily inwardly to decrease the cross sectional area of the fireback from a larger area substantially at the height of the fire bed to smaller area adjacent the throat of the fireplace.

The cross-sectional area may decrease to about 30% of the larger area.

The rear surface of the fire back may follow the same general shape as the inner surface so that the thickness of the wall is substantially uniform.

The fireback may be a generally arcuate wall, preferably semi-circular, in horizontal cross-section and frustoconical in shape with the diameter forming the opening.

Alternatively, the fireback comprises planar walls that slope inwardly with increasing height from the base.

The fireback wall may be a portion of a pyramid having a polygonal base, preferably comprising at least six sides with fire opening the opening being on the centre line. A pyramidal firewall may be made in one piece, or a number of faces which are fixed together by suitable means to form the pyramidal shape.

The inner surface of the fireback wall may have its surface area increased by having raised surface features, for example ribs, corrugations or undulations formed therein, or by having spaced projections such as fingers, bosses, honeycombs etc formed thereon.

For a fireback having a semi-circular frustoconical shape, the corrugations or undulations form peaks lying in planes substantially parallel to the base of the fireback.

The lower portion of the fireback from its base to a height substantially level with the fire bed may be vertical, or alternatively may be an extension of the sloping wall.

The frustoconical fireback may be formed as a single piece, preferably including any surface features for increasing the surface area of the inner surface.

The fireback may be made as a single refractory concrete casting, or be made from bricks, tiles, or blocks as is mentioned in BS 1251:1987.

The invention also comprises fireplaces incorporating firebacks according to the present invention.

A further aspect of the present invention comprises a method of making a fireplace in which a fireback according to the present invention is built into the fireplace.

DESCRIPTION OF DRAWINGS

The invention will be described by way of example only, and with reference to the accompanying drawings in which:

The invention will be explained by reference to a common prior art open fireplace. With reference to FIGS. 1 & 2, there is shown a prior art open fireplace 10 having a hearth 11, chimney breast 12 and chimney 13. The fireplace 10 is lined with a refractory British Standard fireback 15. The fireback 15 may be assembled from a number of parts for example the two pieces 15A & 15B and comprises vertical side walls 16 & 17 with a back wall 18. The sidewalls 16 & 17 are inclined outwardly from the back wall at about twenty degrees of arc from the normal. The lower back wall 18B is vertical and the upper part 18A of the back wall 18 is angled outwardly at about 35 degrees before returning to form a throat 19 at the entrance to the chimney. A restrictor 20 may be located in the throat 19.

Figure 1:
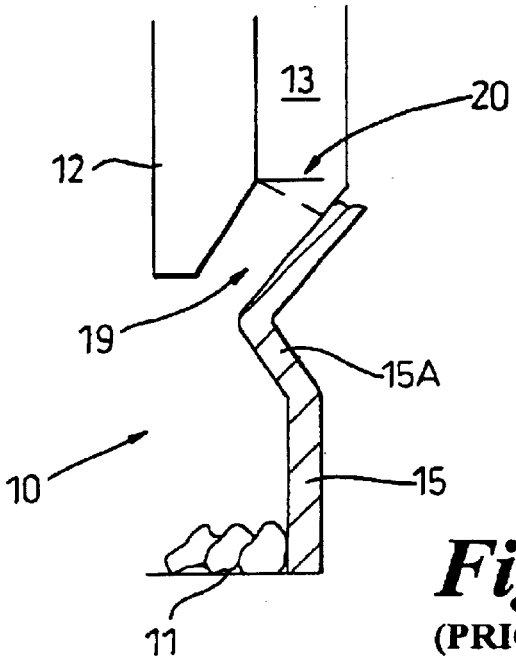
Fig. 1 (PRIOR ART)
FIG. 1 is a section through a fireplace having a British Standard fireback, the section being on the line 1—1 in FIG. 2.
Figure 2:
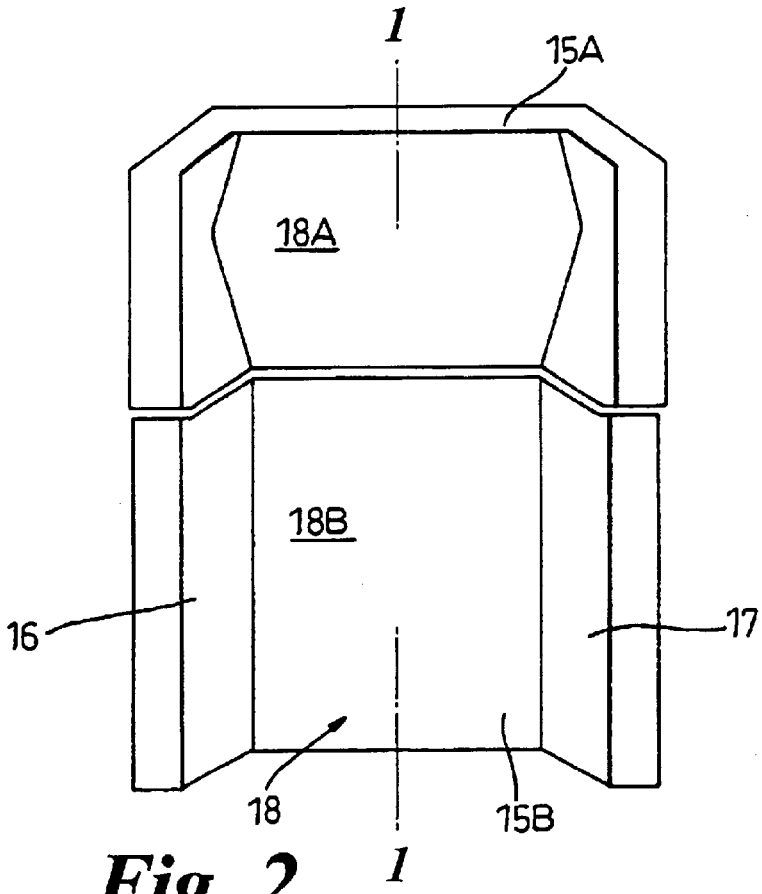
Fig. 2 (PRIOR ART)
FIG. 2 is an isometric view of a British Standard fireback a is shown in BS 1251:1987

In this prior art fireplace the hot gases from a fire rise vertically at first and when they reach the angled back face are caused to change direction. This has the effect that the gases move forwardly and spread sideways. The gas stream is then brought together by the suction of the chimney. The upper part of the back wall is heated by being struck by flames so that it becomes hotter and radiates more heat back into the room, as well as reflecting heat from the flames The standard fireplace has the disadvantage that the side walls and lower part of the back wall are much less struck by the flames and are heated mainly by radiation from the flames. As a consequence the sidewalls and back wall although reflecting heat from the flames do not get as hot and radiate less heat back into the room.

DESCRIPTION OF THE INVENTION

In its broadest aspect the invention lies in the realisation that if all the inner walls of the fireback are sloped or angled inwardly at least from the height of the fire bed upwards, then the flames will strike the walls all the way up and the walls become hotter.

Furthermore sloping the walls inwardly reduces the area of refractory material being heated and therefore the fireback becomes hotter and radiates more heat into a room.

The gradual reduction in width of the fireplace as it rises towards the throat, tends to concentrate the flames so that the cross-section of the throat may be smaller than for a standard fireplace. The draught at this level is correspondingly increased which ensures that substantially all smoke is drawn up the chimney.

A fireplace according to the present invention will now be described with reference to FIGS. 3 to 5 of the drawings. There is shown a fireback 25 having inwardly sloping internal wall surfaces 26. The fireback 25 is substantially in the form or a half cone and has an arcuate, preferably, semi-circular horizontal cross-section is best seen in FIG. 4. An arcuate, or semi-circular, concave section inner surface 26 minimises heat losses into the surrounding wall due to conduction as compared for example with a trapezoid shape.

The fireback 25 has a base portion 27 with semi-cylindrical inner and outer walls and an upper portion 28 with inner and outer generally frustoconical walls. The lower end of the frustoconical walls meet the base portion 27 at a height H above the base 29 which sits on the hearth. The height H, in practice, will be substantially the height of the fire bed which will be taken as the standard height of a fire grate (about 4 inches or 100 mm) above the hearth. The upper portion 28 tapers inwards to a throat 31 at its upper end.

The overall dimensions of the fireback are as is required for a particular fireplace, and may be up to 2 metres in width as viewed from the front, but typically a domestic open fire place will have an overall height of about 400 mm (1 ft 4 in) and the internal diameter at the base will be about 430 mm (1 ft 5 in) and at the throat about 200 mm (8 in.). The walls have a nominal 50 mm thickness (2 in.). The frustoconical walls 28 taper inwardly at an angle $\alpha$ of between 18–23 degrees from the vertical, preferably at about 21 degrees.

The inner surface 26 of the frustoconical portion 28 may have its surface area increased by the presence of surface features in this case, corrugations 30, although other means may be used such as finger-like projections, honey- comb structures, ribs etc. The corrugations 30 are arranged horizontally so that the peaks or troughs lie in respective planes. These corrugations help increase the turbulence of the upward flow of hot gases helping mix combustible gases with air so that they burn within the fire place, and slowing down the upward flow. The corrugations preferably have a wavelength of about 50 mm and height of about 10 mm from trough to peak .

The fireback need not be provided with the semi-cylindrical base portion 27 and alternatively the frustoconical portion 28 could be continued downwards to the base which sits on the hearth.

A fireplace according to the present invention is best utilised without a grate when burning wood or peat, but with a standard grate when burning coal. It is also suitable for the use of hydrocarbon gas fuels, with or without simulated solid fuel.

Figure 3:
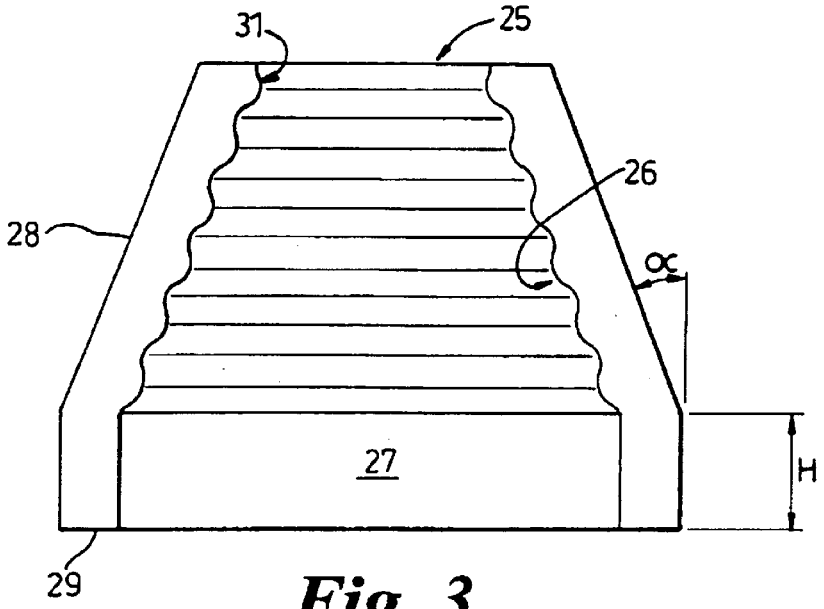
FIG. 3 is a front elevation of a fireback according to the present invention.
Figure 4:
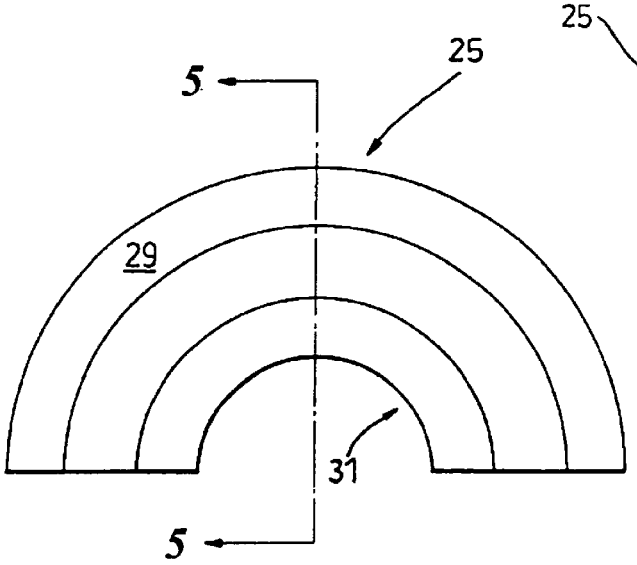
FIG. 4 is a plan view of the fireback shown in FIG. 3.
Figure 5:
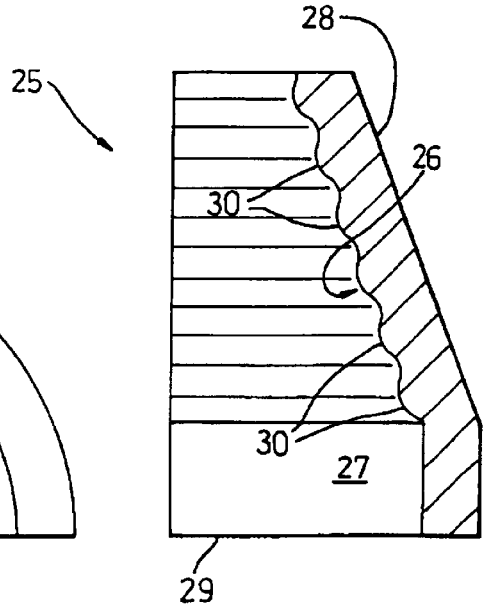
FIG. 5 is a section on the line 5—5 of FIG. 4.

Whilst the invention as shown in FIGS. 3–5 has been described with reference to a frustoconical fireback, other shapes may be used such as planar sided fire backs which are prismoidal in shape, with a polygonal base. Many different shapes may be used and those tending to a semi-circular shape e.g. half hexagons, half octagons, half decahedrons etc will be the most efficient.

Figure 6:
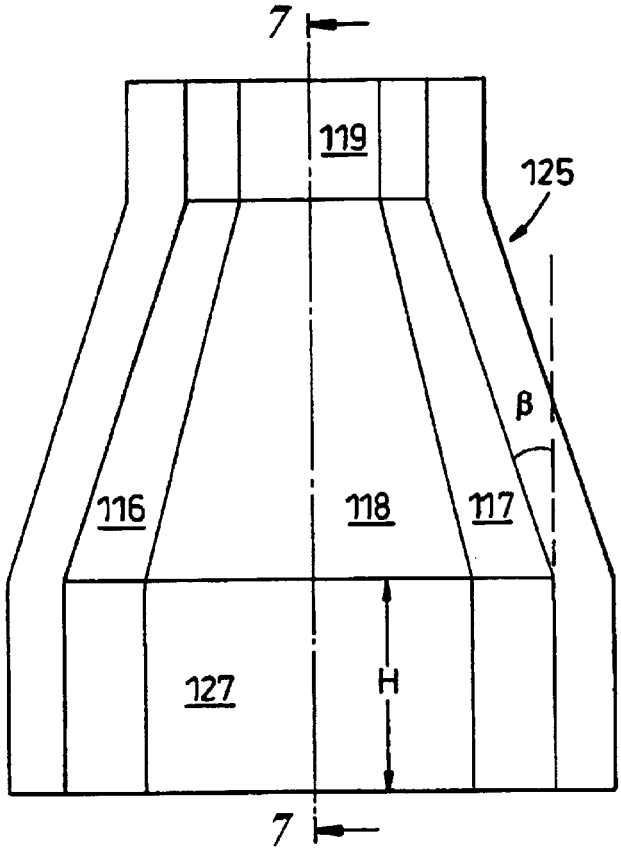
FIG. 6 is a front elevation of a second fireback according to the present Invention.
Figure 7:
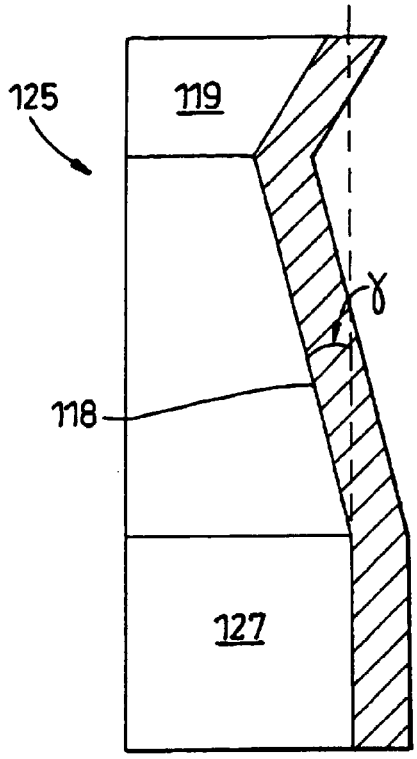
FIG. 7 is a section on the line 7—7 in FIG. 6.
Figure 8:
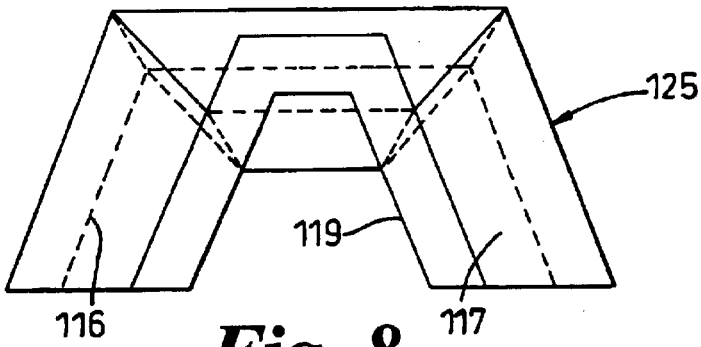
FIG. 8 is a plan view of the fire back shown in FIG. 6.

Referring now to FIGS. 6–8, there is shown another fireback 125 which is the form of one halt of a hexagonal base pyramid with the fire opening on a center line. As previously described the fireback 125 has base portion 127 having vertical walls for a height H that is up to the height of the firebed. The sidewalls 116, 117 and back wall 118 have internal planar surfaces which are inclined inwardly from the base portion 127 up to a throat 119, preferably at angles $\beta$ and $\gamma$ of between 18–23 degrees of arc, which may be different angles or the same angle typically about 18 degrees of arc. The throat 119 is formed integrally with the fireback.

The fireback is preferably cast in one piece from a refractory cement mix which should conform to BS 1902. Part 1A., but could be built of individual heat resistant bricks, tiles or blocks.

What is claimed is:

1. A refractory fireback for use in domestic open fireplaces and which in use surrounds a fire bed and which extends upwardly to a throat which in use connects with a chimney, the fireback having walls with inner surfaces forming one of a generally frustoconical and pyramidal shape with all said inner surfaces sloping steadily inwardly from a height substantially at the level of the firebed to the top of the fireback to decrease continuously at a steady rate with increasing height the cross sectional area within the inner surfaces of the fireback from a larger area substantially at the level of the fire bed to a smaller area at the top of the fireback in use adjacent the throat.

2. A fireback as claimed in claim 1 wherein the inner surfaces of the fireback walls have at least in some places their surface area increased by having raised surface features thereon.

3. A fireback as claimed in claim 2 wherein the inner surfaces have at least in some areas, corrugations or undulation formed thereon.

4. A fireback as claimed in claim 3, wherein the corrugations or undulations form peaks extending substantially parallel to the base of the fireback.

5. A fireback as claimed in claim 1, wherein the inner surfaces of the fireback slope inwardly at an angle of between 15–25 degrees of arc from the vertical.

6. A fireback as claimed in claim 5, wherein the inner surfaces of the fireback are of a generally pyramidal shape.

7. A fireback as claimed in claim 6, wherein the inner surface of the fireback form substantially one half of a pyramid based on a polygon with the fireback opening being formed on a centre line of the base.

8. A fireback as claimed in claim 7, wherein the fireback is formed as a single refractory cement casting.

9. A fireback as claimed in claim 7, wherein the base portion of the fireback from its base to a height substantially level with the fire bed may be vertical.

10. A fireback as claimed in claim 1, wherein the inner surfaces of the fireback are of generally frustoconical shape and are semi-circular in horizontal cross-section with the fireback opening being formed on the diameter thereof.

11. A fireback as claimed in claim 10, wherein the fireback is formed as a single refractory cement casting.

12. A fireback as claimed in claim 10, wherein the base portion of the fireback from its base to a height substantially level with the fire bed may be vertical.

13. A fireback as claimed in claim 1, wherein the inner surfaces of the lower portions of the walls below the level of the firebed are either vertical or an extension of the sloping surfaces.

* * * * *